United States Patent [19]

Mizutani et al.

[11] Patent Number: 4,997,179

[45] Date of Patent: Mar. 5, 1991

[54] AUTOMATIC SHEET FEEDING DEVICE

[75] Inventors: Minoru Mizutani; Shyoichi Watanabe, both of Tokyo; Toshiaki Saito, Fukushima, all of Japan

[73] Assignee: Oki Electric Industry Co., Ltd., Tokyo, Japan

[21] Appl. No.: 433,214

[22] Filed: Nov. 7, 1989

[30] Foreign Application Priority Data

Nov. 8, 1988 [JP] Japan ..... 63-144995[U]

[51] Int. Cl.[5] ..... B65H 29/54

[52] U.S. Cl. ..... 271/306; 271/314; 271/274; 271/3; 400/625

[58] Field of Search ..... 271/3, 4, 274, 273, 271/306, 314, 209, 220, 207, 3.1, 225, 184; 400/625, 629, 636, 636.2, 636.3, 637, 638, 639

[56] References Cited

U.S. PATENT DOCUMENTS 3,430,748 3/1969 Parri ..... 400/625
3,756,589 9/1973 Carbine ..... 271/274

FOREIGN PATENT DOCUMENTS 3527495 2/1986 Fed. Rep. of Germany ..... 400/625

*Primary Examiner*—David H. Bollinger
*Attorney, Agent, or Firm*—Spencer & Frank

[57] ABSTRACT

An automatic sheet feeding device includes a driving roller and a pressing roller which presses a printed sheet against the driving roller. The printed sheet is guided between the driving roller and the pressing roller by a sheet guide fixed to the automatic sheet feeding device or by a leaf spring for supporting the pressing roller.

5 Claims, 6 Drawing Sheets

AUTOMATIC SHEET FEEDING DEVICE

BACKGROUND OF THE INVENTION

1. Field of the Invention

The present invention relates to an automatic sheet feeding device capable of feeding sheets of paper to a printer and collecting and stacking the sheets printed by the printer.

2. Description of the Related Art

Automatic sheet feeding devices have been employed to repeatedly feed paper that has been cut into sheets to a printer. Such a prior art automatic sheet feeding device is generally composed of four elements, namely, a hopper portion for storing the sheets of paper, a sheet feeding portion for feeding the sheets one by one to the printer, a sheet collecting portion for collecting the sheets after they have been printed on and discharged by the printer and a stacking portion for stacking the collected sheets. The sheet collecting portion is composed of a driving roller which rotates synchronously with a sheet feed mechanism of the printer, a pressing roller for rotatably bringing the paper into contact with the driving roller, and a sheet guide for guiding the printed sheet discharged from the printer between the driving roller and the pressing roller.

In the sheet collecting portion, the pressing roller is pressed against the driving roller by a pressing means having resilience such as a leaf spring. Hence, even if the position or the outer diameter of the driving roller is inappropriate or varied, the pressing roller is always urged against the driving roller. It is the same when the driving roller is abraded or worn.

Although the pressing roller moves accompanied by the movement of the driving roller, the guide for guiding the sheet between the driving roller and the pressing roller does not move. Hence, the sheet guide may not function properly. As a result, the sheet may not enter into and be guided by the driving roller and the pressing roller, but is instead liable to be bent just before entering between the driving roller and the pressing roller.

SUMMARY OF THE INVENTION

The present invention has been made in view of the drawbacks of the prior art automatic sheet feeding device set forth above.

Accordingly, it is an object of the present invention to provide an automatic sheet feeding device capable of guiding the printed sheet between the driving roller and the pressing roller without bending the printed sheet even if the position or the diameter of the driving roller is different from the designed value thereof or varied.

To achieve the above object, the automatic sheet feeding device according to the present invention includes a leaf spring as well as a sheet guide, wherein the printed sheet is guided between the driving roller and the pressing roller by the leaf spring or the sheet guide.

The above and other objects, features and advantages of the present invention will become more apparent from the following description taken in conjunction with the accompanying drawings.

DESCRIPTION OF THE PREFERRED EMBODIMENT

An automatic sheet feeding device according to a preferred embodiment of the present invention will be described with reference to FIGS. 1 through 6.

Figure 1:
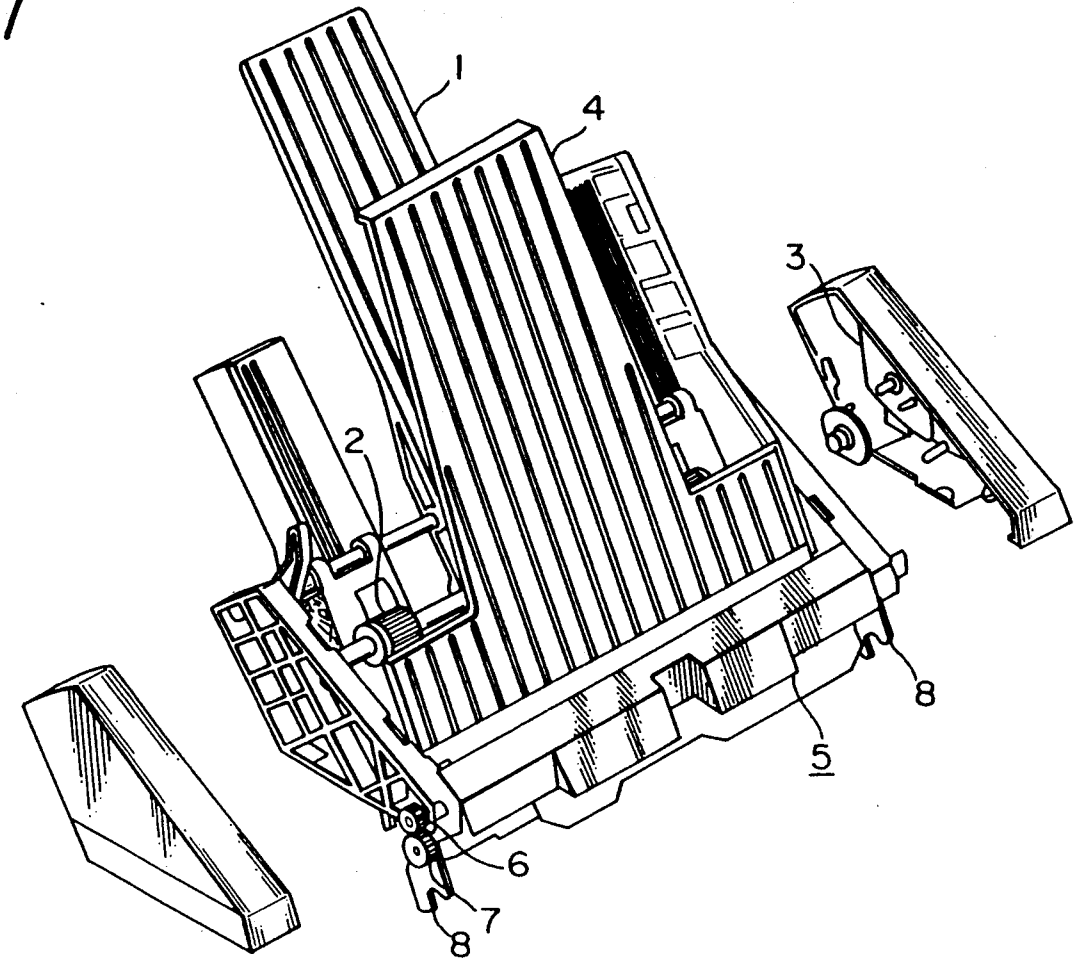
FIG. 1 is exploded perspective view showing an automatic sheet feeding device.
Figure 2:
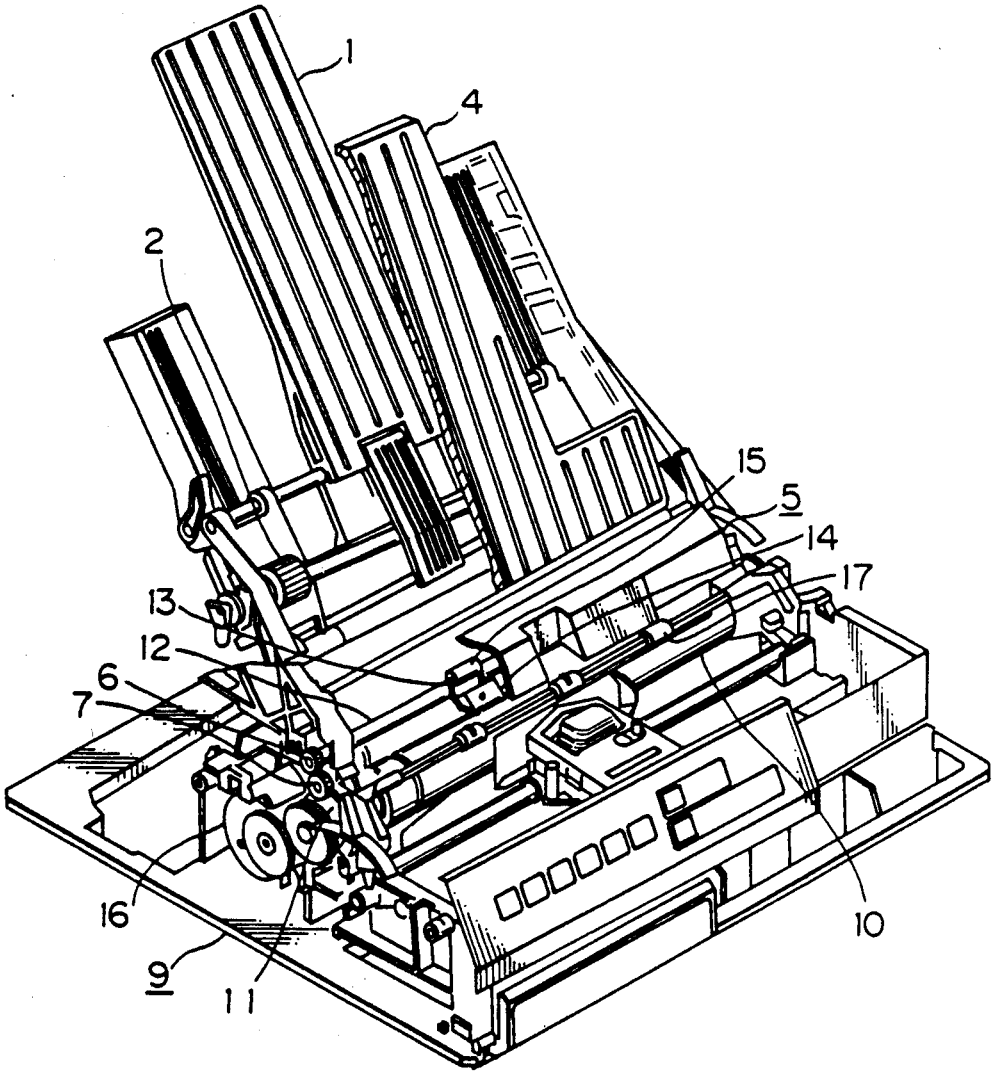
FIG. 2 is a perspective view, partially broken away, showing the automatic sheet feeding device of FIG. 1 mounted on a printer.

FIG. 1 shows the automatic sheet feeding device, and FIG. 2 illustrates it mounted on a printer 9. The automatic sheet feeding device comprises a hopper 1 for storing cut sheet of paper or printing sheets, a hopping roller 2 positioned in front of the hopper 1 for feeding the printing sheets stored in the hopper 1 to the printer 9, a motor 3 positioned at the side of a frame of the automatic sheet feeding device for driving the hopping roller 2, a stacker 4 positioned in front of the hopping roller 2 for stacking the sheets printed by the printer 9, a sheet collector 5 positioned in front of the stacker 4 for feeding the sheets printed by the printer 9 to the stacker 4, a driven gear 6 for transmitting the driving force to the sheet collector 5, an idle gear 7 meshing with the driven gear 6, and a plate 8 engaged with the printer 9. A driving gear 11 rotates integrally with a platen 10 of the printer 9 and meshes with the idle gear 7. A shaft 12 is rotatable integrally with the driven gear 6, and a driving roller 13 is rotatable integrally with the shaft 12. Reference number 14 designates a leaf spring, reference number 15 designates a pressing roller which is rotatably supported by the leaf spring 14, reference number 16 designates a motor for rotating the platen 10, and reference number 17 designates a bail roller for pressing against and contacting the platen 10.

Printed sheets are discharged from the printer 9, pass through the sheet collector 5, and are fed to the stacker 4, where they are stacked.

With the arrangement of the automatic sheet feeding device, when the hopping roller 2 is rotated by the motor 3 a sheet of paper is fed from the hopper 1 toward the platen 10. When the platen 10 is rotated by the motor 16 the sheet moves around the platen 10 while the sheet is printed. The printed sheet is pressed by the bail roller 17 against the platen 10 and enters into the sheet collector 5, where it is clamped between the driving roller 13 and the pressing roller 15. The driving roller 13 is operative connected to the platen 10 via the shaft 12, the driven gear 6, the idle gear 7 and the driving gear 11. The driving roller 13 rotates in synchronism with the platen 10 at substantially the same peripheral speed as that of the platen 10. The printed sheet is fed to the stacker 4 by the driving roller 13 and stacked therein.

Figure 3:
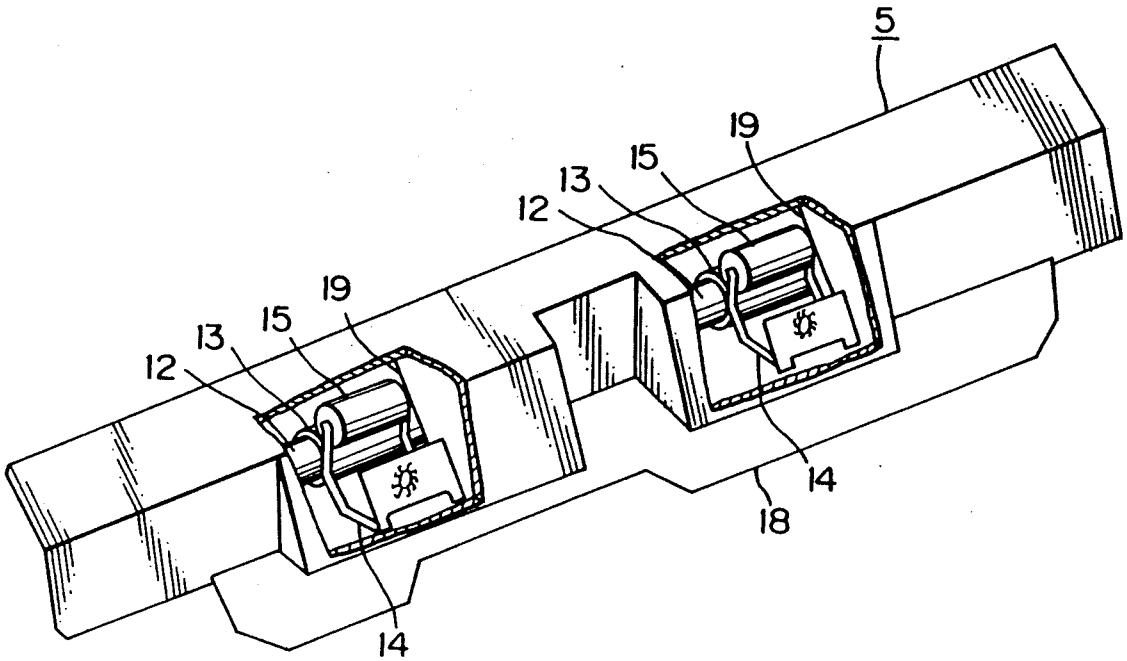
FIG. 3 is a schematic perspective view of the sheet collecting portion of the automatic sheet feeding device of FIG. 1.

The sheet collector 5 is schematically illustrated in FIG. 3. The sheet collector 5 comprises a sheet guide 18 integrally formed with the sheet collector 5 and guide ribs 19 integrally formed with the sheet guide 18. The sheet guide 18 and the guide ribs 19 guide the sheet between the driving roller 13 and the pressing roller 15.

Figure 4:
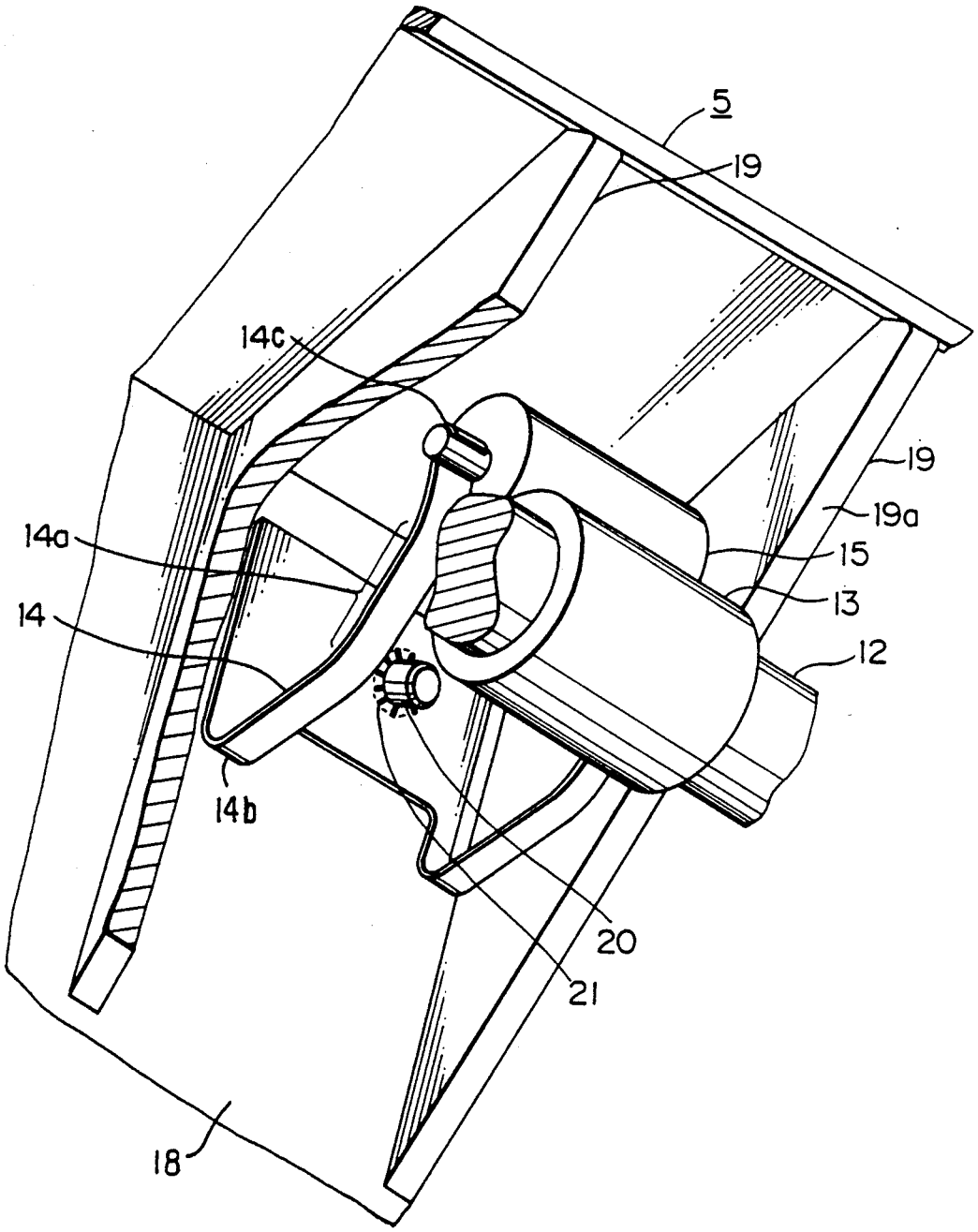
FIG. 4 is a schematic perspective view showing a portion adjacent to a driving roller of the sheet collecting portion of FIG. 3.

The portion adjacent to the driving roller 13 is schematically illustrated in FIG. 4. The sheet guide 18 is integrally provided with a cylindrical projection 20 and the leaf spring 14 has teeth 21. The teeth 21 are arranged annularly and define a circular hole at the central portion thereof. The circular hole has a diameter less than that of the cylindrical projection 20. Hence, the teeth 21 engage with the projection 20 to mount the leaf spring 14 on the sheet guide 18. The leaf spring 14 has a sheet guide portion **14*a* which is disposed between a folded portion 14*b* and a free end 14*c*, the folded portion 14*b* having an acute angle relative to the portion of leaf spring 14 that fixed flush to the sheet guide 18. The leaf spring 14 is bent between the folded portion 14*b* and the free end 14*c* in the direction toward the driving roller 13. The sheet guide portion 14*a* is capable of guiding the sheet between the driving roller 13 and the pressing roller 15 if the position at which the pressing roller is mounted or the diameter of the pressing roller 15** vary.

Figure 5:
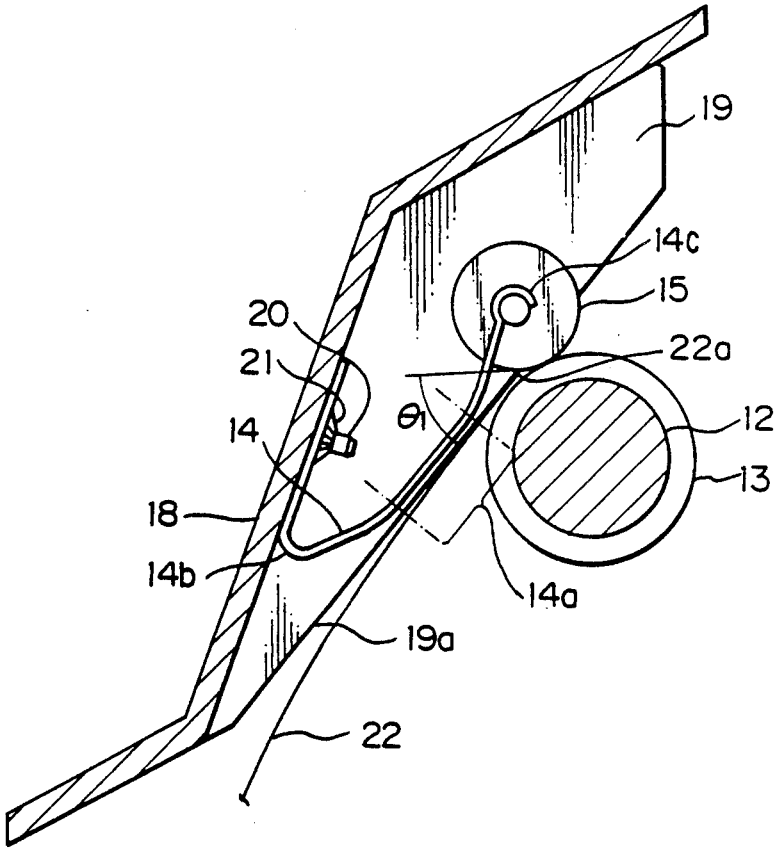
FIG. 5 is a side sectional view of the sheet collecting portion of FIG. 3 wherein a sheet is guided by a guide rib.

A printed sheet 22 is normally guided by the guide rib 19 as illustrated in FIG. 5. When the end **22*a* of the printed sheet 22 reaches the pressing roller 15, the sheet 22 is disposed at an incident angle $\Theta_1$ with respect to the surface of the pressing roller 15. The incident angle $\Theta_1$ is equal to the angle between a lower edge 19*a* of the guide rib 19 and the surface of the pressing roller 15. The incident angle $\Theta_1$ is set to be a small value such that the printed sheet 22 is not prevented from being smoothly guided between the driving roller 13 and the pressing roller 15**.

Figure 6:
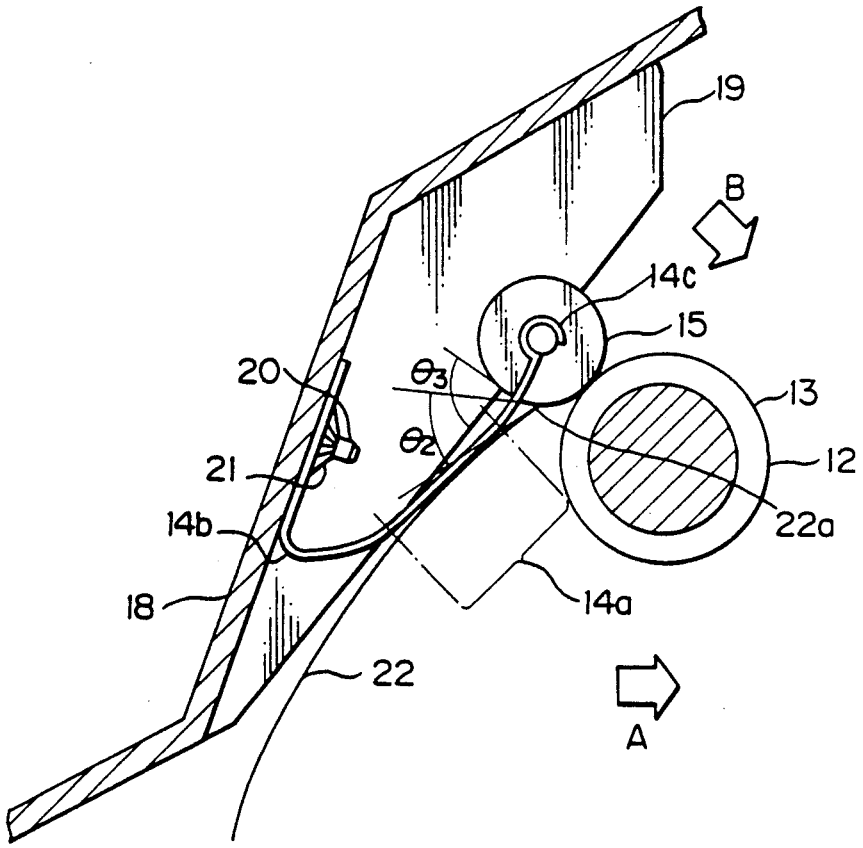
FIG. 6 is a side sectional view corresponding to FIG. 5 but showing the driving roller in a different position, with the sheet being guided by a leaf spring.

When the driving roller 13 deviates in to the direction of the arrow A in FIG. 6, the pressing roller 15 moves as indicated by the arrow B. At that time, the end **22*a* of the printed sheet 22 is guided by the sheet guide portion 14*a* between the driving roller 13 and the pressing roller 15. At this time, the incident angle becomes $\Theta_2$, which is substantially same as the incident angle $\Theta_1$ in FIG. 5. Accordingly, the printed sheet 22 is smoothly guided between the driving roller 13 and the pressing roller 15 irresespective of the angle $\Theta_3$ between the lower edge 19*a* of the guide rib 19 and the surface of the pressing roller 15, which is greater than the incident angle $\Theta_1$ in FIG. 5**.

Although the invention has been described in its preferred form with particularity, it is to be understood that many variations and changes are possible in the invention without departing from the scope thereof.

What is claimed is:

1. An automatic sheet feeding device adapted to be mounted on a printer, comprising:

a stacker to stack sheets printed by the printer;

a driving roller for feeding a printed sheet to the stacker;

a pressing roller to press the printed sheet against the driving roller, the pressing roller having a periphery;

a sheet guide, fixed to the automatic sheet feeding device and extending above the driving roller, for guiding the printed sheet between the driving roller and the pressing roller, the periphery of the pressing roller normally having a predetermined position with respect to the sheet guide; and a leaf spring fixed to the sheet guide, the leaf spring having a folded portion which is disposed adjacent the sheet guide and which is bent at an angle, the leaf spring further having a free end for rotatably supporting the pressing roller and for urging the pressing roller toward the driving roller, the leaf spring additionally being bent between the folded portion and the free end to provide a sheet guide portion which protrudes in the direction of the driving roller, the sheet guide portion acting in lieu of the sheet guide to guide the printed sheet between the driving roller and the pressing roller if the periphery of the pressing roller deviates from the predetermined position with respect to the sheet guide.

2. An automatic sheet feeding device according to claim 1, wherein the printer has a sheet feeding mechanism which moves, and wherein the automatic sheet feeding device further comprises means for rotating the driving roller in synchronism with the movement of the sheet feeding mechanism of the printer.

3. An automatic sheet feeding device according to claim 2, wherein the sheet guide comprises a guide rib for guiding the printed sheet between the driving roller and the pressing roller.

4. An automatic sheet feeding device according to claim 3, wherein the leaf spring has two divided portions which support both ends of the pressing roller.

5. An automatic sheet feeding device according to claim 1, wherein the angle at which the folded portion of the leaf spring is bent is an acute angle.

* * * * *